US010816934B2

(12) United States Patent
Bazin et al.

(10) Patent No.: US 10,816,934 B2
(45) **Date of Patent: *Oct. 27, 2020**

(54) MOVEMENT WITH POWER RESERVE EXTENSION

(71) Applicant: The Swatch Group Research and Development Ltd, Marin (CH)

(72) Inventors: Jean-Luc Bazin, Tuscherz-Alfermee (CH); Paulo Bravo, Marin-Epagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/707,796

(22) Filed: Dec. 9, 2019

(65) Prior Publication Data

US 2020/0110363 A1 Apr. 9, 2020

Related U.S. Application Data

(63) Continuation of application No. 15/887,375, filed on Feb. 2, 2018, now Pat. No. 10,514,659.

(30) Foreign Application Priority Data

Mar. 30, 2017 (EP) ..... 17163951

(51) Int. Cl.
*G04B 19/02* (2006.01)
*G04B 17/28* (2006.01)
(Continued)

(52) U.S. Cl.
CPC ..... *G04B 19/02* (2013.01); *G04B 1/12* (2013.01); *G04B 17/06* (2013.01); *G04B 17/285* (2013.01); *G04C 3/08* (2013.01)

(58) Field of Classification Search
CPC ..... G04B 19/02; G04B 1/12; G04B 17/06; G04B 17/285; G04B 17/20; G04B 17/26; G04C 3/08; G04F 7/08; G04F 7/0823
(Continued)

(56) References Cited

U.S. PATENT DOCUMENTS 7,527,423 B2 5/2009 Ruchonnet
8,356,929 B2 * 1/2013 Zaugg ..... G04B 19/262 368/127

(Continued)

FOREIGN PATENT DOCUMENTS

CH 697 074 A5 4/2008
EP 2 570 869 A1 3/2013

OTHER PUBLICATIONS

European Search Report dated Oct. 2, 2017 in European Application 17163951.1, filed on Mar. 30, 2017 (with English Translation of Categories of cited documents).

*Primary Examiner* — Edwin A. Leon
(74) *Attorney, Agent, or Firm* — Oblon, McClelland, Maier & Neustadt, L.L.P.

(57) ABSTRACT

A timepiece movement is provided, including a first regulating member and a first escapement associated therewith; a first train connecting the first escapement to a first energy source; a second regulating member and a second escapement associated therewith; a second train connecting the second escapement to a second energy source; a display of a current time; at least one differential gear including a first input wheel meshing with the first train and a second input wheel meshing with the second train, the at least one differential gear driving the display, where the second regulating member consumes less energy than the first regulating member.

12 Claims, 7 Drawing Sheets

(51) Int. Cl.

| | |
|---|---|
| ***G04B 1/12*** | (2006.01) |
| ***G04B 17/06*** | (2006.01) |
| ***G04C 3/08*** | (2006.01) |

(58) Field of Classification Search
USPC .... 368/64, 97, 101, 124, 127, 140, 169, 168
See application file for complete search history.

(56) References Cited

U.S. PATENT DOCUMENTS

| | | | | |
|---|---|---|---|---|
| 8,905,630 | B2 * | 12/2014 | Helfer | G04F 7/08 368/101 |
| 9,081,365 | B2 * | 7/2015 | Behrend | G04B 15/06 |
| 9,134,702 | B2 * | 9/2015 | Kasapi | G04B 17/285 |
| 9,958,833 | B2 | 5/2018 | Sarchi | |
| 10,514,659 | B2 * | 12/2019 | Bazin | G04B 19/02 |
| 2006/0221775 | A1 | 10/2006 | Zaugg | |
| 2010/0002548 | A1 | 1/2010 | Hessler | |
| 2010/0214879 | A1 | 8/2010 | Lechot | |
| 2011/0096636 | A1 | 4/2011 | Pellet | |
| 2011/0164474 | A1 | 7/2011 | Jolidon | |
| 2013/0070568 | A1 | 3/2013 | Helfer et al. | |

* cited by examiner

MOVEMENT WITH POWER RESERVE EXTENSION

CROSS-REFERENCE TO RELATED APPLICATIONS

This application is a continuation application of and claims the benefit of priority under 35 U.S.C. § 120 to U.S. application Ser. No. 15/887,375, filed on Feb. 2, 2018, and claims benefit of priority under 35 U.S.C. § 119 from European Patent Application No. 17163951.1, filed on Mar. 30, 2017, the entire contents of each of which are incorporated herein by reference.

FIELD OF THE INVENTION

The invention relates to a timepiece movement comprising a power reserve extension device, to limit the energy consumption of the movement when the watch is not worn, or in a rest position.

BACKGROUND OF THE INVENTION

Usually, in mechanical watches, the energy source for driving the train and the hands, and other functions, is a spiral spring wound inside a barrel.

When a mechanical watch is not wound regularly, or when a self-winding watch is not worn for several hours, the watch spring is completely let down, and the watch stops. The average power reserve of a normal watch whose mainspring is completely wound is around 40 to 60 hours.

There are several reasons for a watch to discharge energy until it stops, especially not wearing a watch for some time (storage, weekend, etc. . . . ) or forgetting to wind the watch if it does not have a self-winding mechanism. It is therefore useful to have a watch with a greater than average power reserve.

In the past, attempts have already been made to overcome the problem of power reserve. For example, EP Patent Application No 2455820 proposes the use of a drive member comprising a barrel inside which are mounted two superposed and coaxial springs.

This document simply provides an example of watches with two barrels or two mainsprings since there are many similar publications.

Such proposed solutions to overcome the problem of increasing power reserve are of little interest, because the power reserve is given priority at the expense of available space.

SUMMARY OF THE INVENTION

It is an object of the invention to overcome the various drawbacks of these known techniques.

More specifically, it is an object of the invention to provide a movement for timepieces can obtain a better power reserve by limiting the energy consumption of the movement when it is not being worn or is in a rest position.

It is also an object of the invention, at least in a particular embodiment, to avoid excessive thickness of the movement and therefore of the watch.

These objects, in addition to others, which will appear more clearly hereinafter, are achieved according to the invention by means of a timepiece movement comprising a first regulating member and a first escapement connected by a first train to a first energy source, the first train, the first escapement, the first regulating member and the first energy source defining a first assembly, a second regulating member and a second escapement connected by a second train to a second energy source, the second train, the second escapement, the second regulating member and the second energy source defining a second assembly, at least one differential gear arranged to ensure a kinematic connection between the first assembly and the second assembly, and means for displaying the current time.

According to the invention, the timepiece movement includes means for stopping and allowing operation of one of the two regulating members, and said differential gear carries the time display means to display the time regardless of which regulating member is operating.

Thus, the subject of the present invention, through its different functional and structural aspects described above, makes it possible to obtain an increased power reserve.

In accordance with other advantageous variants of the invention:

- the differential gear is arranged to ensure a kinematic connection between the first train and the second train;
- the regulating members are of the same type;
- the regulating members are of different types;
- at least one regulating member is a tourbillon or a karussel;
- at least one of the escapements is an escapement with very low energy consumption;
- the means for stopping and allowing operation of a regulating member comprise a manual control;
- the means for stopping and allowing operation of one of the regulating members comprise a first lever arranged to be actuated by the manual control, the first lever acting on a second lever provided with two friction members arranged to move into mesh with the first train or the second train;
- the means for stopping and allowing operation of one of the regulating members comprise a third lever arranged to cooperate, on the one hand with the second lever when the manual control is actuated, and on the other hand, arranged to cooperate with an oscillating weight during rotation of the latter.

The invention also concerns a timepiece equipped with a movement according to the invention.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

A timepiece movement according to the invention will be described below referring jointly to FIGS. 1, 2*a*, 2*b*, 3*a*, 3*b*, 4*a*, 4*b*, 5*a*, 5*b*, 6*a*, 6*b*, 7*a*, 7*b* and 7*c*.

The movement according to the invention comprises a first regulating member and a first escapement connected by a first train to a first energy source, the first train, the first escapement, the first regulating member and the first energy source defining a first assembly, a second regulating member and a second escapement connected by a second train to a second energy source, the second train, the second escapement, the second regulating member and the second energy source defining a second assembly, at least one differential gear provided to ensure a kinematic connection between the first assembly and the second assembly, and means for displaying the current time.

Further, the timepiece movement includes means for stopping and allowing operation of one of the two regulating members, and the differential gear carries time display means to display the time regardless of which regulating member is operating.

The regulating members can be chosen from among a conventional balance, a karussel, a tourbillon, a resonator (of the tuning fork or magnetic rotor type, for example), a motor driven balance or a quartz oscillator.

Hereinafter, and for the sake of clarity, there is described a movement according to the invention, which comprises at least two regulating members, each provided with an escapement, given as a simple illustrative and non-limiting example. As previously described, any type of regulating member can be used, and a tourbillon/quartz oscillator combination could, for example, be envisaged.

Figure 1:
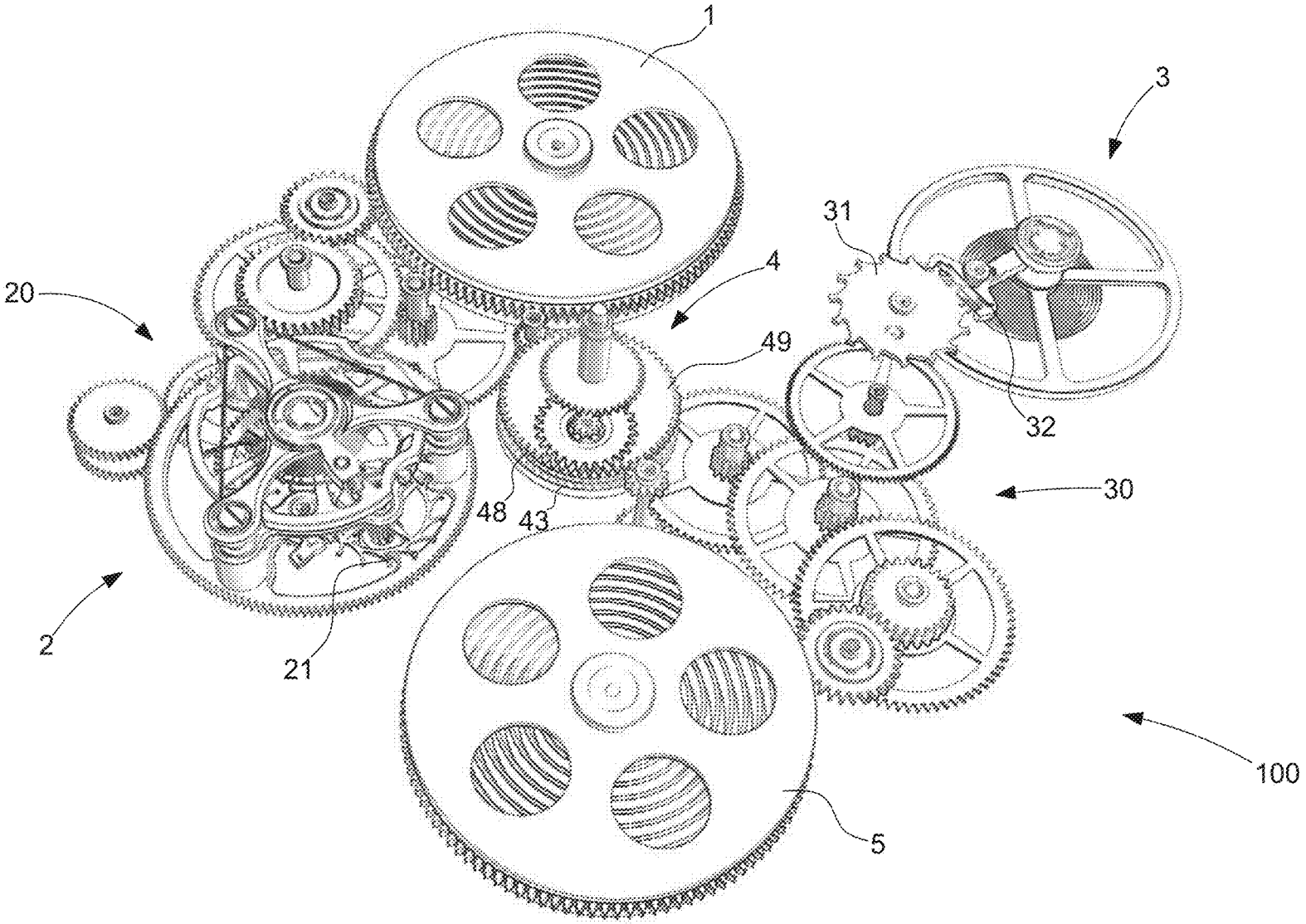
FIG. 1 illustrates a perspective view of a timepiece movement according to the invention.

Referring to FIG. 1, the timepiece movement according to the invention includes, in particular:

a first mechanical energy source 1, and a second mechanical energy source 5, such as barrels, for example;

a first, preferably high precision, regulating member 2, and a first escapement, comprising a first escape wheel 21 and a first pallet-lever 22, connected by a first train 20 to energy source 1, the first escapement, barrel 1, first train 20, and first regulating member 2 forming a first assembly, a second regulating member 3, preferably with low energy consumption, and a second escapement comprising a second escape wheel 31 and a second pallet-lever 32, connected by a second train 30 to energy source 1, the second escapement and the second regulating member 3 forming a second assembly, a differential gear 4 provided to ensure a kinematic connection between the first assembly and the second assembly, differential gear 4 being connected to first regulating member 2 and to second regulating member 3 respectively by the first and second trains 20 and 30.

In the embodiment represented in the Figures, regulating members 2 and 2 are respectively a tourbillon and a simple sprung balance, but those skilled in the art could of course use two simple sprung balances, two tourbillons, two karussels, or one of each. Likewise, the first and second escapements represented are Swiss lever escapements, but they could be of another type, such as detent escapements or other types of known escapements.

According to another variant of the invention, not represented in the Figures, regulating members 2 and 3 may be a conventional sprung balance associated with a quartz resonator, or a tourbillon associated with a quartz oscillator, or any other combination of two of the aforecited regulating members imagined by those skilled in the art.

Thus, in the embodiment illustrated in the Figures, the first regulating member 2 used is a tourbillon, and the second regulating member 3 is a simple balance with low energy consumption, such as a 1 Hz balance.

Figure 6A:
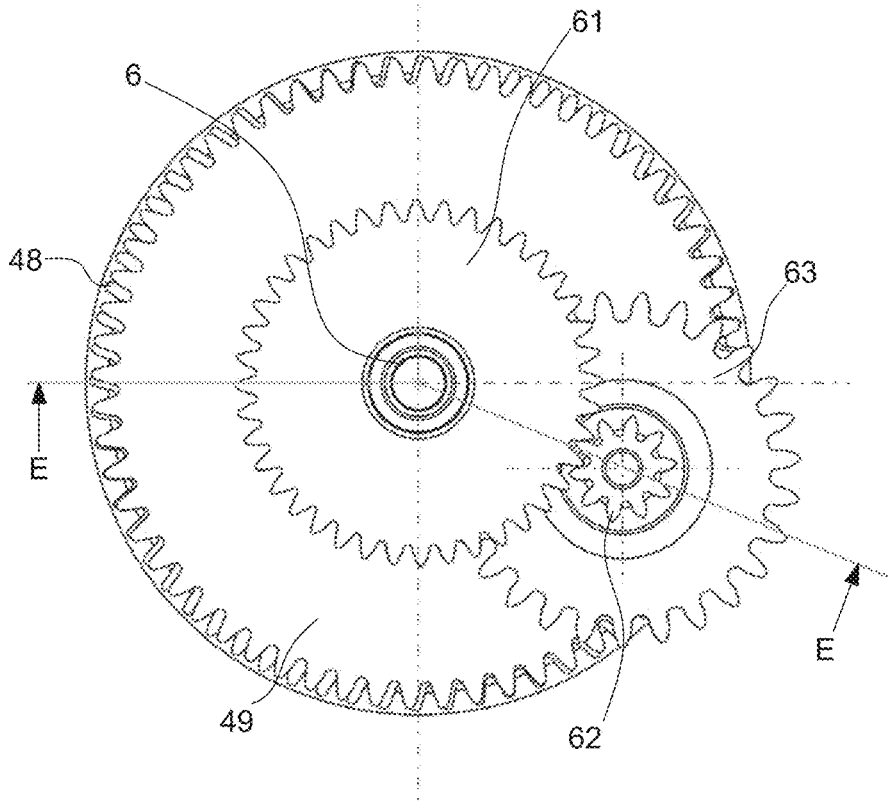
FIGS. 6*a* and 6*b* respectively represent a top view and a cross-sectional view along line E-E of a differential gear of a timepiece movement according to the invention.
Figure 6B:
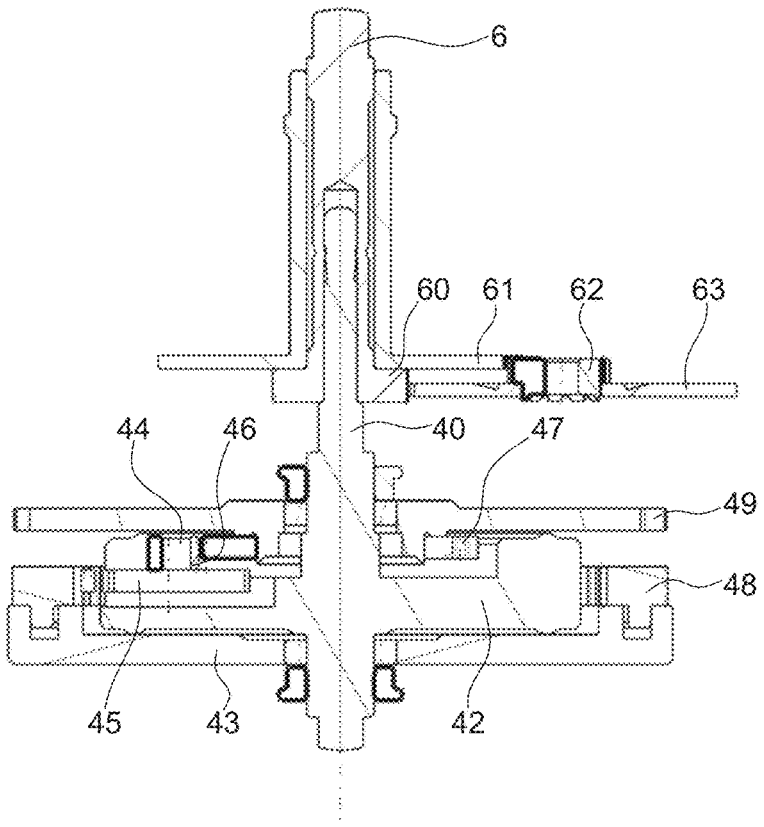

As can be observed in FIGS. 6*a* and 6*b*, differential gear 4 comprises an arbor 40, carrying time display means 6 at a first end of arbor 40, and comprises a planetary wheel carrier 42 in proximity to the other end of arbor 40. Advantageously, planetary wheel carrier 42 is integral with arbor 40.

It is evident that the movement may comprise several wheel sets between differential gear 18 and energy source 1.

Planetary wheel carrier 42 comprises a planetary wheel carrier arbor 44 parallel to arbor 40, on which are pivotably mounted two planetary pinions. In the illustrated embodiment, a first planetary pinion, referred to as lower planetary pinion 45, and a second planetary pinion, referred to as upper planetary pinion 46, are arranged integrally and coaxially mounted on planetary wheel carrier arbor 44.

Several planetary pinions (or several double planetary wheels), for example two or three, could also be provided, so as to ensure better stress distribution.

Differential gear 4 also comprises a first input wheel 48 having an outer toothing and an inner toothing, and a second input wheel 49 having an outer toothing, each being respectively mounted for free rotation about arbor 40.

First input wheel 48 is mounted on a plate 43 mounted for free rotation about arbor 40, underneath planetary wheel carrier 42, by means of a pipe, for example. Plate 43 and first input wheel 48 have a larger diameter than that of planetary wheel carrier 42, such that the inner toothing of first input wheel 48 is meshed with planetary toothing 45 when the outer toothing of input wheel 48 is meshed with first train 20.

Differential gear 4 also comprises a transmission wheel 47 mounted about arbor 40, underneath second input wheel 49 and integral therewith, transmission wheel 47 having an outer toothing intended to be meshed by the toothing of upper planetary pinion 46 when second input wheel 49 is meshed by second train 30.

This differential gear 4 is described as an illustrative and non-limiting example, and those skilled in the art could evidently implement any other type of differential gear to achieve proper operation of the timepiece movement.

Figure 2A:
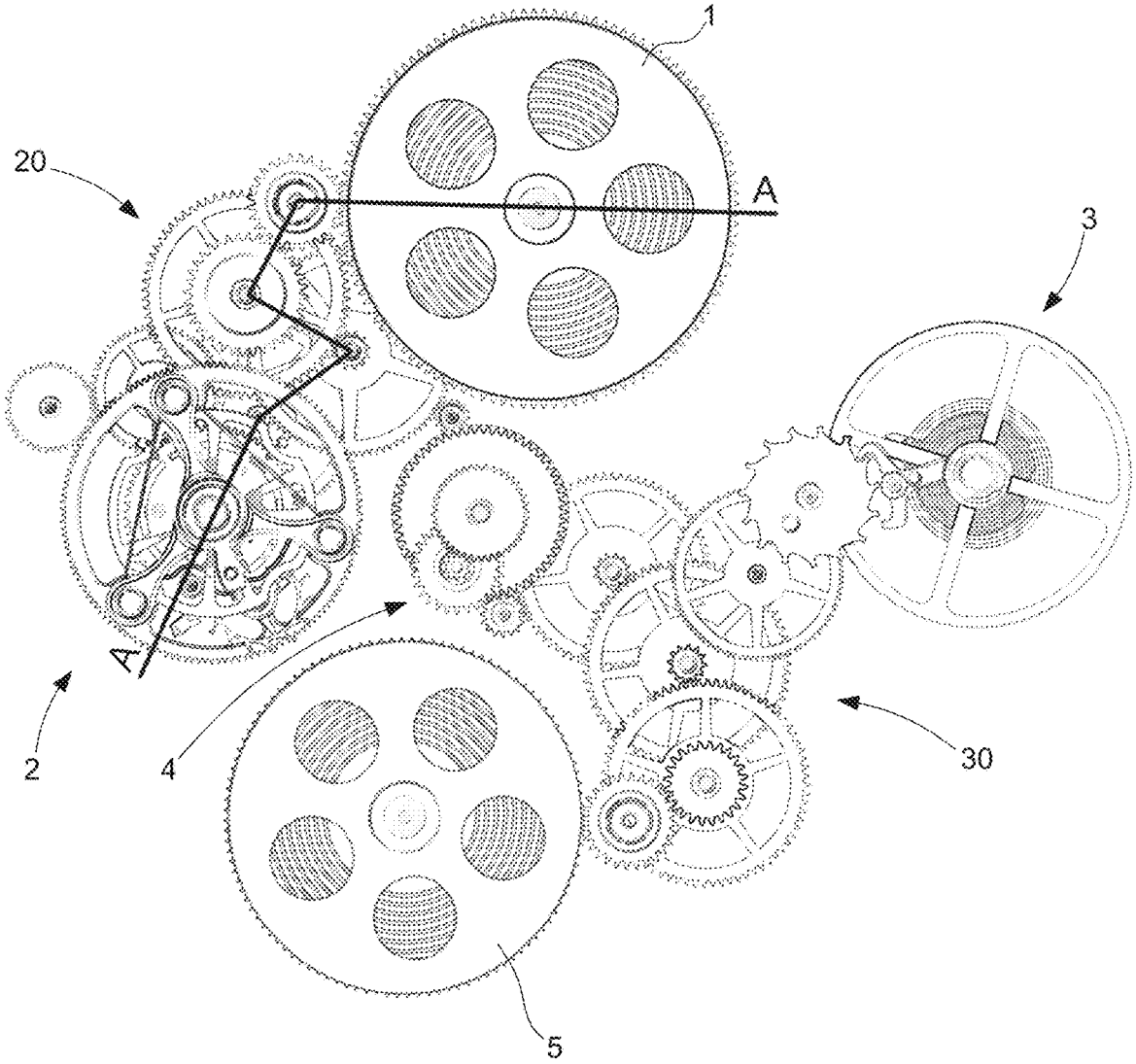
FIGS. 2*a* and 2*b* respectively represent the distribution of energy to a first regulating member seen in a top view and cross-sectional view along line AA of a timepiece movement according to the invention.
Figure 2B:
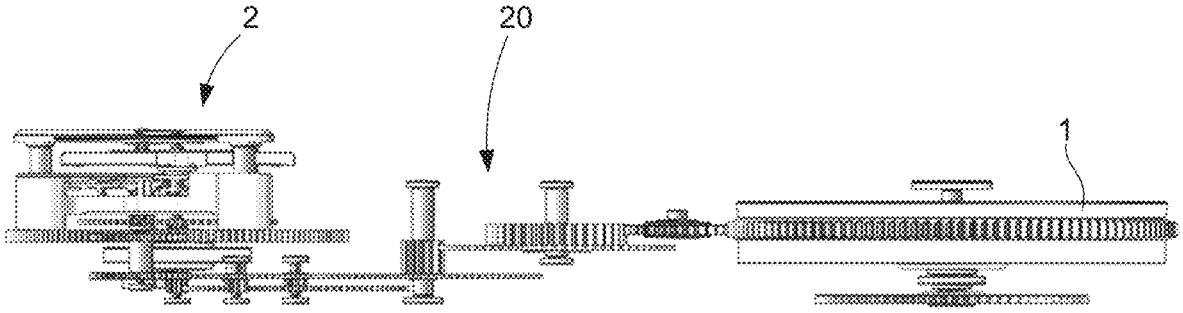
Figure 3A:
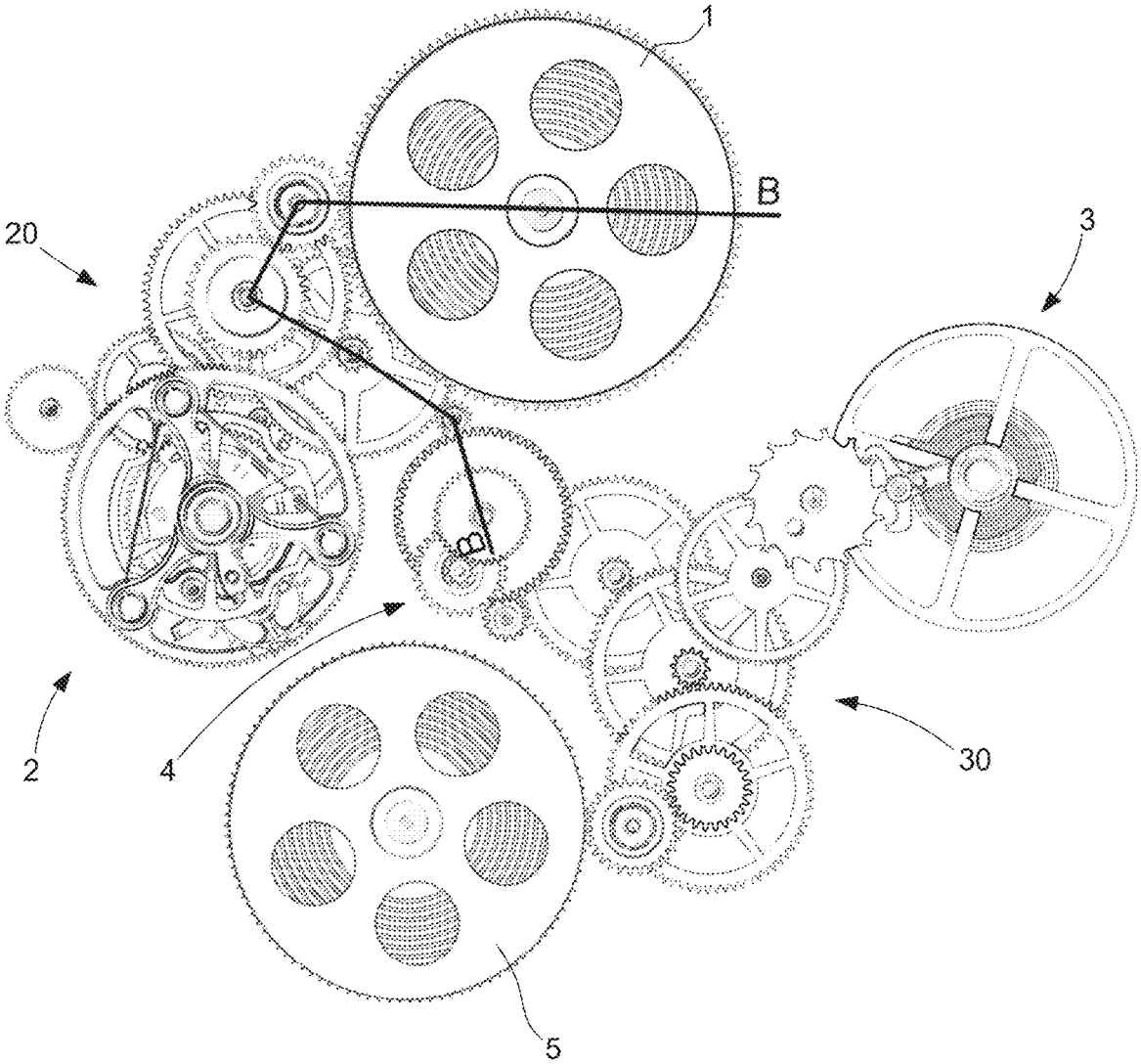
FIGS. 3*a* and 3*b* respectively represent the kinematic connection between the first regulating member and the differential gear seen in a top view and cross-sectional view along line B-B of a timepiece movement according to the invention.
Figure 3B:
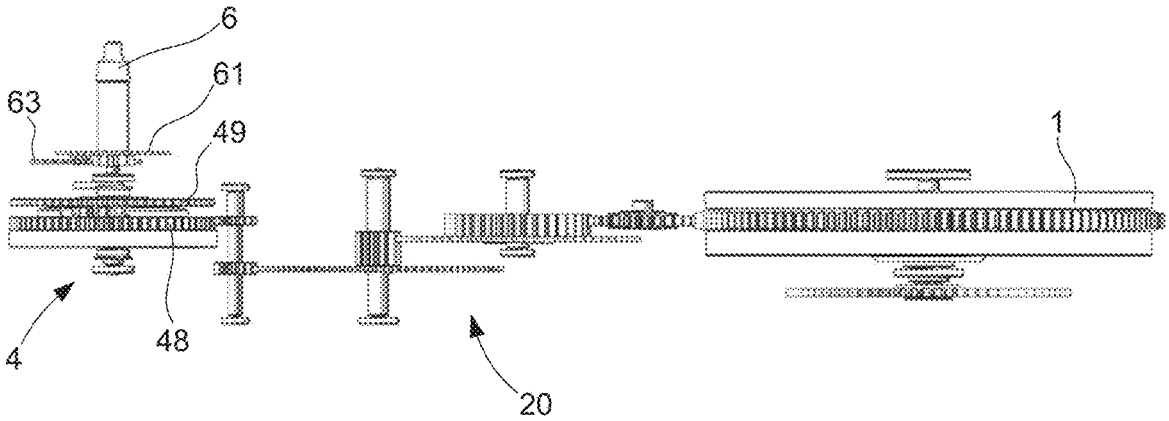

The distribution of energy to first regulating member 2 is represented in FIGS. 2*a* and 2*b*. The energy from barrel 1, or the drive force, is transmitted to first train 20, and reaches first regulating member 2 via escapement 21.

Figure 4A:
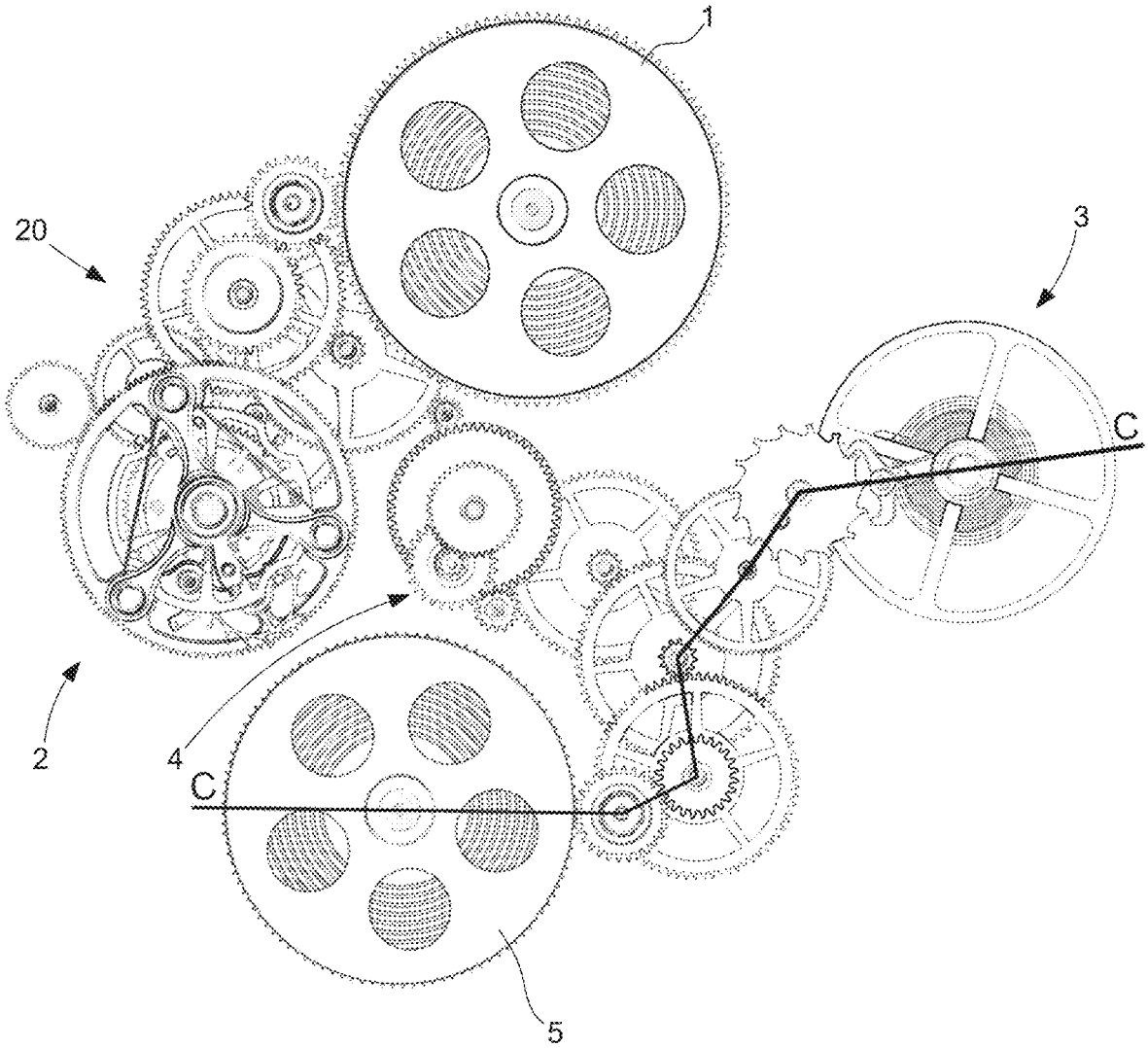
FIGS. 4*a* and 4*b* respectively represent the distribution of energy to a second regulating member seen in a top view and cross-sectional view along line CC of a timepiece movement according to the invention.
Figure 4B:
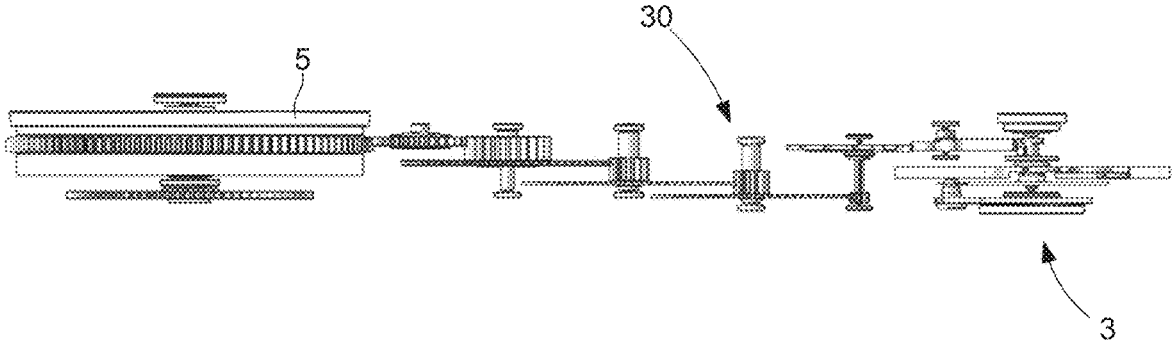
Figure 5A:
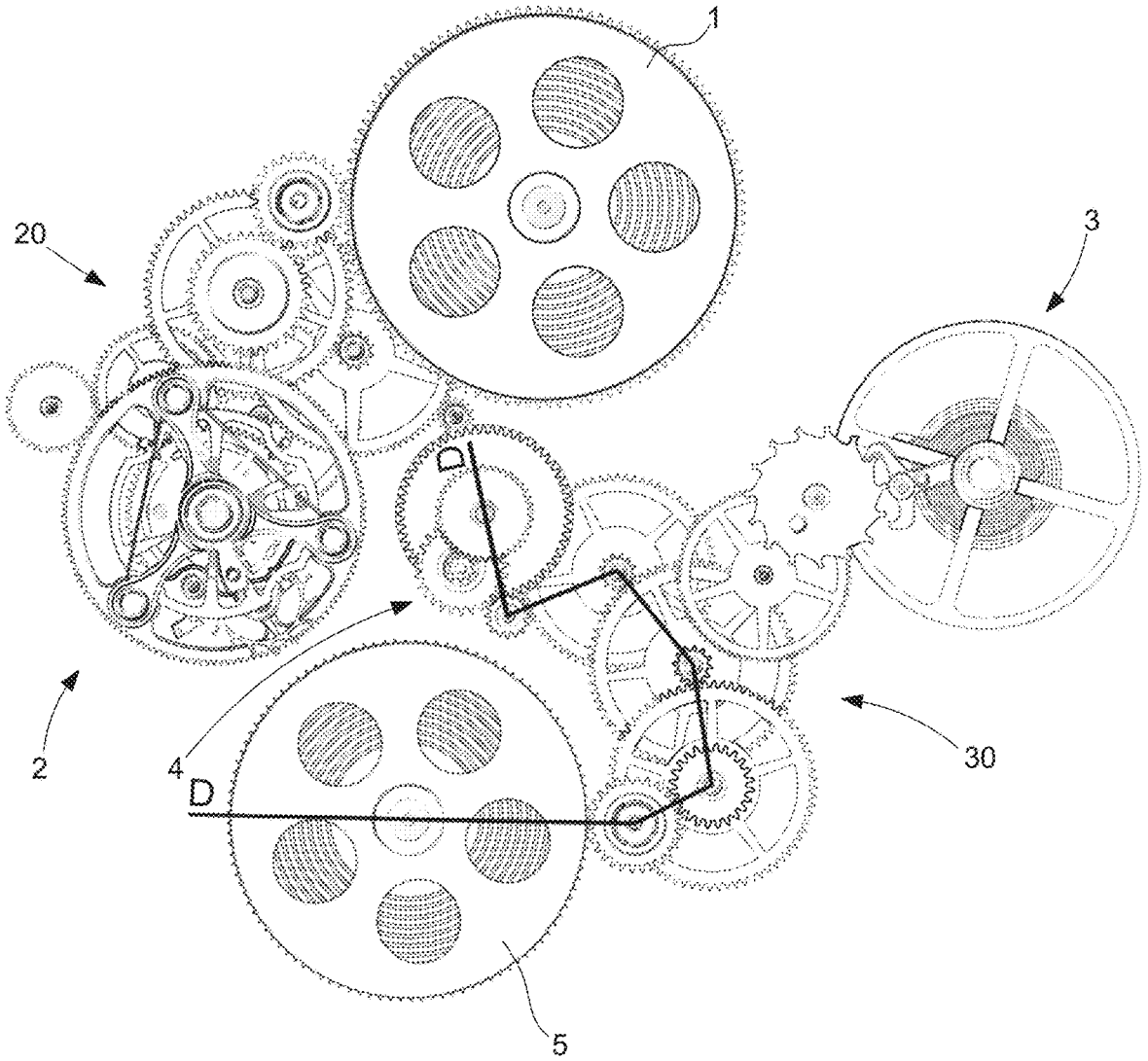
FIGS. 5*a* and 5*b* respectively represent the kinematic connection between the second regulating member and the differential gear in a top view and cross-sectional view along line D-D of a timepiece movement according to the invention.
Figure 5B:
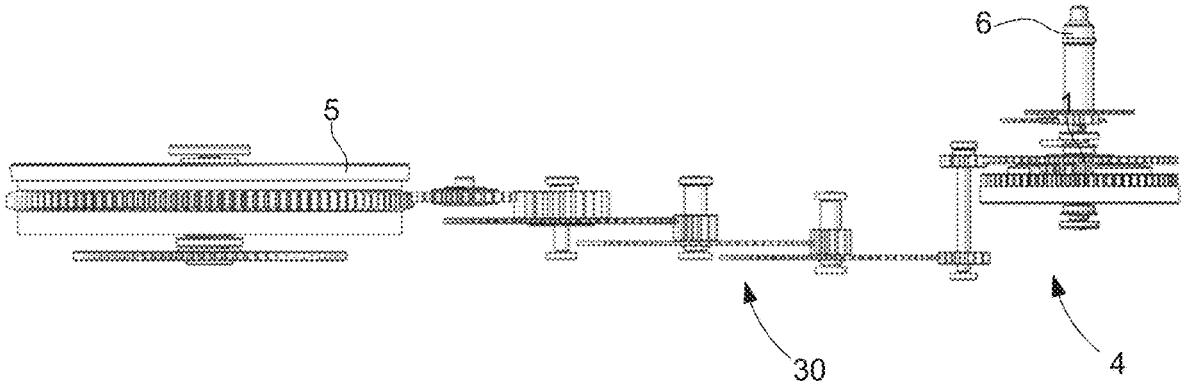

Likewise, the distribution of energy to second regulating member 3 is represented in FIGS. 4*a* and 4*b*. The energy from barrel 5 is transmitted to second train 30, and reaches second regulating member 3 via escapement 31.

FIGS. 3*a*, 3*b* and 5*a*, 5*b* respectively illustrate the kinematic connection between first regulating member 2 and differential gear 4, and the kinematic connection between second regulating member 3 and differential gear 4 in order to display the current time.

According to the invention, the timepiece movement also includes means for stopping and allowing operation of one of the regulating members, preferably the member with the highest energy consumption, when the user is not wearing the watch. In the case illustrated in the Figures, it is the tourbillon which is stopped when the watch is not worn.

Figure 7A:
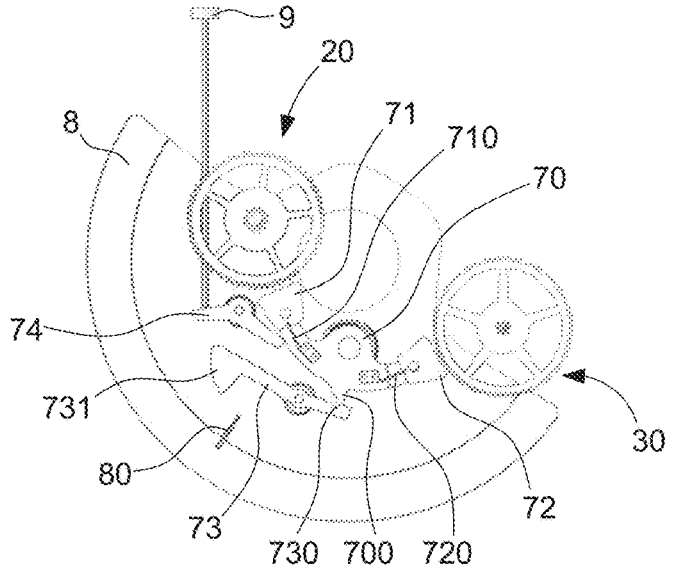
FIGS. 7*a* to 7*c* illustrate the means for stopping and allowing operation of one of the two regulating members of a timepiece movement according to the invention.
Figure 7B:
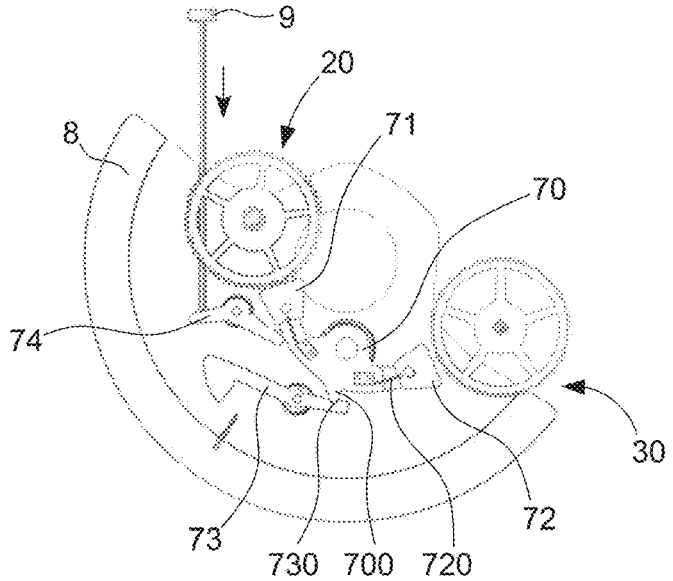
Figure 7C:
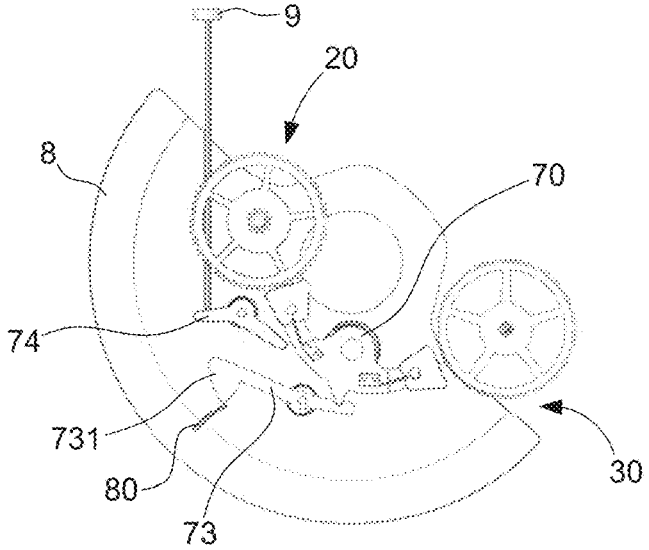

These means for stopping and allowing operation of one of the regulating members are illustrated in FIGS. 7*a* to 7*c* and are arranged to cooperate with an oscillating weight and a pusher, for example.

The stopping of first train 20, and thus of the tourbillon in the case illustrated, is achieved by means of a manual control, such as a pusher 9, to lock first train 20 and release second train 30 connected to the conventional sprung balance, which is stopped when the watch is worn.

To stop tourbillon 2 and start conventional sprung balance 3, the user need only press pusher 9, or place the watch in its rest position—namely on the edge of the case middle—so that pusher 9 rests against a support, in order for the pusher to be depressed under the weight of the watch and to stop the regulating member using the most energy, which is tourbillon 2 here.

More specifically, the means for stopping and allowing operation of one of the regulating members comprise a first lever 74 controlled by pusher 9, first lever 74 acting on a second lever 70 provided with two friction members 71, 72, each connected to this second lever by means of a strip spring 710, 720, so as to limit mechanical stresses when one of friction members 71, 72 moves into mesh with first train 20 or second train 30. Second lever 70 is rotatably mounted on a bar (not visible in the Figures) and is stressed by a helical spring in the locking position of second train 30.

The means for stopping and allowing operation of one of the regulating members also comprise a third lever 73, rotatably mounted on the same bar (not visible in the Figures) and which is also stressed by a helical spring. Third lever 73 includes, on the one hand, a hollow 730 arranged to cooperate with a beak 700 of second lever 70 when pusher 9 is pressed, and on the other hand, a beak 731 arranged to cooperate with oscillating weight 8 via a lug 80 integral with the oscillating weight during rotation of the latter.

Thus, once pusher 9 has been pressed, first lever 74 acts on second lever 70 to pivot the latter such that friction member 71 moves into mesh with first train 20 and friction member 72 releases second train 30; beak 700 then becomes lodged inside hollow 730 of third lever 73 and locks the position of the second lever.

To release beak 700 from hollow 730, and therefore to release tourbillon 2 and lock sprung balance 3, only one rotation of the oscillating weight is needed for lug 80 to strike beak 731 of third lever 73, which has the effect of dislodging beak 700 of second lever 70 from the hollow of second lever 73 and thus of releasing first train 20 and simultaneously locking second train 30.

Advantageously, the oscillating weight can rotate in both directions.

According to a particular embodiment of the invention, the regulating member with low energy consumption, which is a simple sprung balance here, as illustrated in the Figures, can be tilted, by 30° for example, to optimise its operation and limit errors when the movement/watch is in the rest position.

As mentioned above, the mechanism can stop and actuate all other types of escapements, for example a standard Swiss lever escapement and a standard balance, automatically, when the user is not wearing the watch, or on demand by the user in order to save energy.

When first regulating member 2 is powered by barrel 1, first train 20 transmits its energy and its rotational movement to differential gear 4 via input wheel 48. The rotational movement is then transmitted to planetary pinion 45 via the inner toothing of input wheel 48; planetary pinion 45 then drives pinion carrier 42 and arbor 40 in rotation.

Finally, arbor 40 drives in rotation the current time display means 6, namely a tube 60 fixedly mounted on arbor 40; tube 60 can carry a hand to indicate the minutes. Current time display means 6 also comprise a second tube 61, rotatably mounted on first tube 60, and meshed by train 62, 63 in order to indicate the hours.

As a result of these different aspects of the invention, there is provided a movement of simple design which can extend the power reserve of the movement.

Of course, this invention is not limited to the illustrated example but is capable of various variants and alterations that will appear to those skilled in the art.

What is claimed is:

1. A timepiece movement, comprising:

a first regulating member and a first escapement associated with the first regulating member;

a first train connecting the first escapement to a first energy source;

a second regulating member;

a second escapement associated with the second regulating member;

a second train connecting the second escapement to a second energy source;

means for displaying a current time;

at least one differential gear comprising a first input wheel meshing with the first train and a second input wheel meshing with the second train, the at least one differential gear driving the means for displaying the current time, wherein the second regulating member consumes less energy than the first regulating member; and means for stopping and allowing operation of each of the first and the second regulating members, said means being configured to jointly lock in position the first train and the first regulating member, while allowing operation of the second train and the second regulating member, and to jointly lock in position the second train and the second regulating member, while allowing operation of the first train and the first regulating member, wherein the at least one differential gear is configured such that the means for displaying the current time can display the current time regardless of which regulating member, of the first and the second regulating members, has been allowed to operate.

2. The timepiece movement according to claim 1, wherein the at least one differential gear carries the means for displaying the current time.

3. The timepiece movement according to claim 1, wherein the first and the second regulating members are of a same type of regulating member.

4. The timepiece movement according to claim 1, wherein the first and the second regulating members are of different types of regulating members.

5. The timepiece movement according to claim 1, wherein at least one regulating member of the first and the second regulating members is a tourbillon or a karussel.

6. The timepiece movement according to claim 1, wherein at least one regulating member of the first and the second regulating members is a sprung balance.

7. The timepiece movement according to claim 1, wherein the first and the second regulating members operate at different frequencies, the second regulating member operating at a lower frequency than that of the first regulating member.

8. The timepiece movement according to claim 1, wherein the means for stopping and allowing operation of each of the first and the second regulating members comprise a first lever configured to be actuated by a manual control, the first lever being configured to act on a second lever provided with two friction members configured to, when the second lever is alternately pivoted in two directions between two locking positions, respectively and alternately jointly lock in position the first train and the first regulating member, and jointly lock in position the second train and the second regulating member.

9. The timepiece movement according to claim 8, wherein the two friction members are further configured to respectively and alternately engage with the first train and the second train when the second lever is alternately pivoted in the two directions between the two locking positions.

10. The timepiece movement according to claim 8, wherein each of the two friction members is linked to the second lever by means of a strip spring.

11. The timepiece movement according to claim 8, wherein the means for stopping and allowing operation of each of the first and the second regulating members further comprises a third lever configured to cooperate with the second lever when the manual control is actuated in order to lock the second lever in a first position from among the two locking positions, wherein the first regulating member and the first train are locked in position and configured to cooperate with an oscillating weight during a rotation of the oscillating weight, in order to unlock the second lever, when the oscillating weight is in the first position, and allow the second lever to pivot as far as the second of the two locking positions, and wherein the second regulating member and the second train are locked in position.

12. A timepiece including the timepiece movement according to claim 1.

* * * * *